US007357168B2

(12) United States Patent
Mitsam

(10) Patent No.: US 7,357,168 B2
(45) Date of Patent: Apr. 15, 2008

(54) CONVEYANCE DEVICE IN AN EMBOSSING DEVICE

(75) Inventor: Reinwald Mitsam, Langenzenn (DE)

(73) Assignee: Leonard Kurz GmbH & Co. KG, Furth (DE)

( * ) Notice: Subject to any disclaimer, the term of this patent is extended or adjusted under 35 U.S.C. 154(b) by 337 days.

(21) Appl. No.: 10/510,922

(22) PCT Filed: Mar. 29, 2003

(86) PCT No.: PCT/DE03/01042

§ 371 (c)(1),
(2), (4) Date: Apr. 14, 2005

(87) PCT Pub. No.: WO03/086779

PCT Pub. Date: Oct. 23, 2003

(65) Prior Publication Data

US 2006/0108071 A1 May 25, 2006

(30) Foreign Application Priority Data

Apr. 12, 2002 (DE) ..... 102 16 139

(51) Int. Cl.
*B32B 37/00* (2006.01)

(52) U.S. Cl. ..... 156/540; 156/553

(58) Field of Classification Search ..... 156/538, 156/439, 553, 555, 580, 582, 583.1, 583.5, 156/209, 219, 539, 540
See application file for complete search history.

(56) References Cited

U.S. PATENT DOCUMENTS 4,194,944 A 3/1980 Spätle
5,421,951 A * 6/1995 Troutner et al. ..... 156/580

FOREIGN PATENT DOCUMENTS

| | | |
|---|---|---|
| DE | 41 21 766 | 1/1973 |
| DE | 25 53 802 A | 6/1977 |
| DE | 27 21 980 A | 11/1978 |
| DE | 100 37 643 | 2/2002 |
| EP | 0 109 313 | 5/1984 |

* cited by examiner

*Primary Examiner*—James Sells
(74) *Attorney, Agent, or Firm*—Hoffman & Baron, LLP

(57) ABSTRACT

Described is an embossing apparatus for transferring a transfer layer of an embossing film on to a substrate body which is stable in respect of shape. The embossing station has two mutually spaced support rollers and a deflection roller around which runs an embossing belt. An embossing section of the embossing belt is defined by the support rollers. Provided in the proximity of the embossing station in parallel relationship with the embossing section is a transport device which is provided for transporting the substrate body to be embossed. The embossing belt and the transport device are driven simultaneously at the same advance speed.

14 Claims, 2 Drawing Sheets

CONVEYANCE DEVICE IN AN EMBOSSING DEVICE

This application claims priority based on an International Application filed under the Patent Cooperation Treaty, PCT/DE03/01042, filed on Mar. 29, 2003, which claims priority based on German Patent Application No. 102 16 139.9-14, filed on Apr. 12, 2002, which are incorporated herein by reference.

BACKGROUND OF THE INVENTION

The invention concerns an embossing apparatus for transferring a transfer layer of an embossing film on to a substrate body which is stable in respect of shape, comprising an embossing station having two mutually spaced support rollers around which an embossing belt runs, wherein an embossing section of the embossing belt is defined by the support rollers, and comprising a transport device provided for transporting the substrate body which is stable in respect of shape and which is to be embossed, the transport device being disposed parallel to the embossing section and in the proximity of the embossing station, wherein the embossing belt and the transport device are driven simultaneously at the same advance speed.

An embossing apparatus of that kind is known from DE 41 21 766 C2. The web of material which is referred to therein is a flexible web of material or a web of material which is not flexible or which is only limitedly flexible. The embossing apparatus has a heated support device and a pressing roller arrangement. The web of material and the embossing film are transported through an embossing section defined between the support device and the pressing roller arrangement. The support device of that known embossing apparatus has at least two mutually spaced support rollers which are at least in axis-parallel relationship with each other and around which runs a heated endless support body belt which is driven by means of a drive. The embossing section is of a contact length which is defined by the spacing between the axes of the two support rollers which are furthest away from each other. At least one pressing roller of the pressing roller arrangement is associated with each of the two support rollers or at least the two support rollers which are furthest away from each other.

DE 100 37 643 A1 describes an embossing machine for pressing and/or embossing an embossing film on to a suitable material, comprising a pressure cylinder which is rotatably mounted stationarily in the embossing machine and a pressure punch having a heating device, the punch being displaceable in the embossing machine horizontally below the pressure cylinder between a starting position and an end position. The embossing film can be unwound from a supply roll at the side of the punch which is remote from the pressure cylinder and is passed beneath the surface of the punch back to a winding-on device at the side of the punch which is remote from the pressure cylinder. Provided between the supply roll and the punch in the advance direction of the embossing film is an advance device for the embossing film.

SUMMARY OF THE INVENTION

The object of the invention is to provide an embossing apparatus of the kind set forth in the opening part of this specification, with which substrate bodies which are stable in respect of shape such as tabletops, floor, wall or ceiling boards or panels can be embossed with an embossing film at a relatively high embossing speed.

In accordance with the invention that object is attained by the features of claim 1, that is to say in that the transport device has a fixing device with fixing elements which form at least one endless member by which at least one fixing section parallel to the embossing section is defined.

In the embossing apparatus according to the invention the fixing device can be formed by a clamping device with clamping elements which form two endless members in mutually adjacent relationship and which define a common clamping section parallel to the embossing section. The clamping elements can be for example connected together hingedly with respect to the respective endless member. Another possible option provides for example that the fixing device of the transport device, instead of clamping elements, has suction elements which, connected hingedly to each other, form a single endless member. It is also possible to associate with the transport device two embossing stations which are disposed in laterally mutually opposite relationship.

In the embossing apparatus according to the invention the embossing station is of a similar configuration to that of the embossing apparatus in accordance with above-quoted DE 41 21 766 C2. The embossing apparatus according to the invention however does not have any pressing rollers and in that respect is of a different configuration from the embossing apparatus in accordance with DE 41 21 766 C2. By means of the embossing apparatus according to the invention it is easy and possible at a high level of productivity for substrate bodies which are stable in respect of shape in the form of boards, plates, sheet members, panels or the like to be embossed with the transfer layer of an embossing film, in particular a hot embossing film.

In the case of the embossing apparatus according to the invention it has proven desirable—as in the case of the embossing apparatus in accordance with DE 41 21 766 C2—if the embossing station has a deflection roller which is provided in a triangular configuration in a common plane with the two support rollers and around which the embossing belt is guided. By virtue of such a configuration, it is easily possible in a space-saving arrangement for a heating device to be associated with the embossing belt, which heating device is formed by a pair of heating elements which are associated with the embossing belt at the triangle side portions between the respective support roller and the common deflection roller in order to provide for optimum heating of the embossing belt.

In the case of the embossing apparatus according to the invention it is desirable if the embossing belt is driven by means of a first drive device and the transport device is driven by means of a second drive device simultaneously in mutually matched relationship so that the embossing belt and the transport device involve the same advance speed. That can be implemented by suitable control or coupling between the first and the second drive devices.

With the embossing apparatus according to the invention it has proven to be advantageous if the embossing belt at its side towards the transport device has a profiling which is adapted to the substrate body to be embossed upon. In accordance with the invention it is easily possible for an embossing belt with a given profiling to be replaced by another embossing belt with a different profiling in order to emboss corresponding substrate bodies which are stable in respect of shape with the transfer layer of an embossing film, in optimum fashion.

Desirably the embossing station is displaceable in relation to the transport device. That displaceability involves in particular displaceability towards and away from the transport device, that is to say in a horizontal direction, and displaceability in a vertical direction.

In order to be able to emboss dimensionally stable panel or board-shaped substrate bodies with varying profiling with an embossing film as desired at their narrow sides, it is desirable if the embossing station is pivotable about a pivot axis which is oriented in parallel relationship with the advance direction of the transport device.

In order to avoid the embossing belt bulging up along the embossing section between the two support rollers, that is to say to prevent the embossing belt from moving away from the substrate body which is stable in respect of shape and which is to be embossed along the embossing section, at least one stabilisation roller which bears against the embossing belt can be provided between the two support rollers along the embossing section. That at least one stabilisation roller provides that the embossing belt bears reliably against the substrate body to be embossed, along the embossing section, so that embossing is applied exactly to the respective substrate body which is stable in respect of shape.

BRIEF DESCRIPTION OF THE DRAWINGS

Further details, features and advantages will be apparent from the description hereinafter of an embodiment, diagrammatically illustrated in the drawing, of the embossing apparatus according to the invention or essential details thereof. In the drawing.

DETAILED DESCRIPTION OF THE INVENTION

Figure 1:
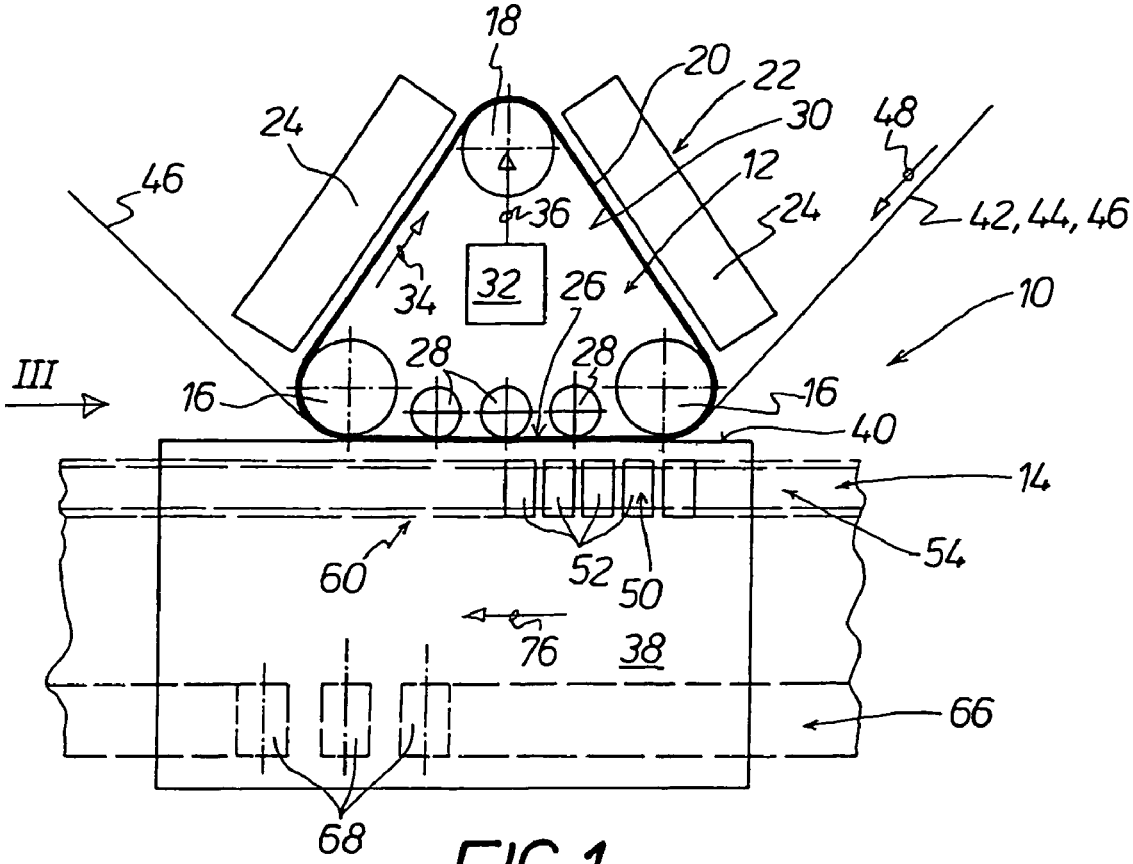
FIG. 1 shows a diagrammatic plan view of an embodiment of the embossing apparatus.

FIG. 1 diagrammatically shows an embodiment by way of example of the embossing apparatus 10 comprising an embossing station 12 and a transport device 14. The embossing station 12 has two mutually spaced support rollers 16 and a deflection roller 18. The support rollers 16 and the deflection roller 18 are arranged in mutually axis-parallel relationship in a common plane in a triangle, preferably an isosceles triangle. An embossing belt 20 runs around the support rollers 12 and the deflection roller 18. The embossing belt 20 is heatable by means of a heating device 22 having two heating elements 24.

The two mutually spaced support rollers 16 define an embossing section 26 of the embossing belt 20. Provided between the two support rollers 16 along the embossing section 26 at the embossing station 12 are stabilisation rollers 28 which bear against the rear side 30 of the endless embossing belt 20.

The embossing belt 20 is drivable by means of a first drive device 32 so that the embossing belt 20 passes around the support rollers 16 and the deflection roller 18 at a given advance speed. That advance speed is indicated by the arrow 34.

The first drive device 32 is operatively connected for example to the deflection roller 18. That is indicated by the arrow 36.

The transport device 14 of the embossing apparatus 10 serves for holding fast and for definedly advancing a substrate body 38 which is stable in respect of shape, which is to be embossed upon, in relation to the embossing apparatus 10 in order for example to emboss the respective narrow side 40 of the stable substrate body 38 with the transfer layer 42 of an embossing film 44 which in particular can involve a hot embossing film. The embossing film 44, comprising the carrier film 46 and the decorative transfer layer 42, is fed to the embossing station 10 at a speed corresponding to the advance speed 34 of the embossing belt 20. That is indicated by the arrow 48. Along the embossing section 26 the transfer layer 42 is detached from the carrier film 46 of the embossing film 44 and transferred on to the narrow side 40 of the substrate body 38 which is stable in respect of shape. After the embossing section 26 therefore only the carrier film 46 of the embossing film 44 is then discharged from the embossing station 12.

It is also possible for example, by virtue of the transport device 14 being of a suitable configuration, to emboss a substrate body 38 which is stable in respect of shape, along its entire peripheral edge, in one working operation. In that case therefore the transport device 14 is suitable not only for linear advance of the substrate body 38 but also for rotation thereof.

Figure 2:
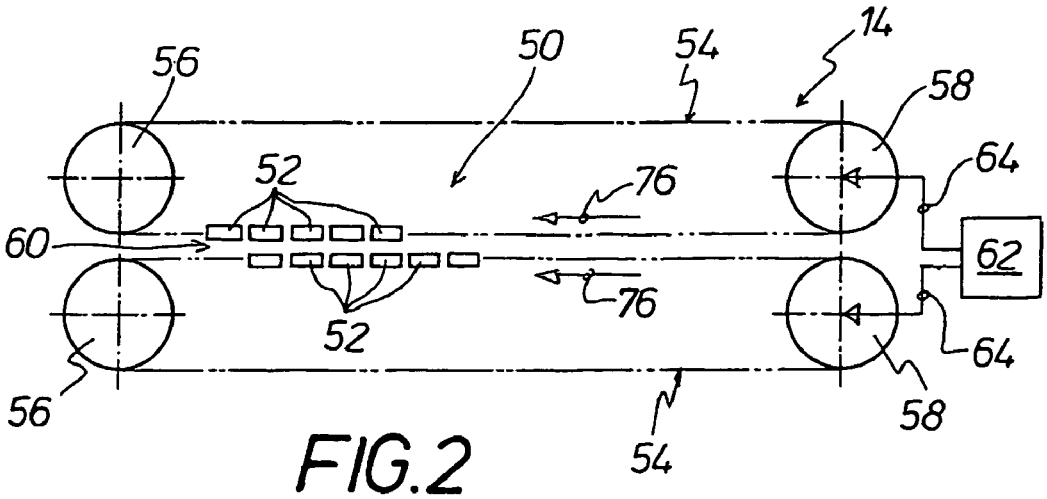
FIG. 2 shows a diagrammatic side view of the transport device of the embossing apparatus of FIG. 1.

In the configuration of the embossing apparatus 10 shown in FIG. 1 the transport device has a clamping device 50 with clamping elements 52 (see in particular also FIGS. 2 and 3) which form two mutually adjacent endless members 54. For that purpose the clamping elements 52 are for example respectively hingedly connected together. FIGS. 1 and 2 each diagrammatically show only some of the clamping elements 52 which are deflected around the deflection rollers 56 and 58. The two endless members 54 are arranged in mutually adjacent relationship in such a way that the clamping elements 52 form a common clamping section 60, along which the dimensionally stable substrate body 38 which is to be embossed upon is reliably held fast and transported by means of the transport device 14. For that purpose the transport device 14 has a second drive device 62 (see FIG. 2) which for example is operatively connected to the deflection rollers 58 of the two endless members 54. That operative connection is indicated by the angled arrows 64.

Figure 3:
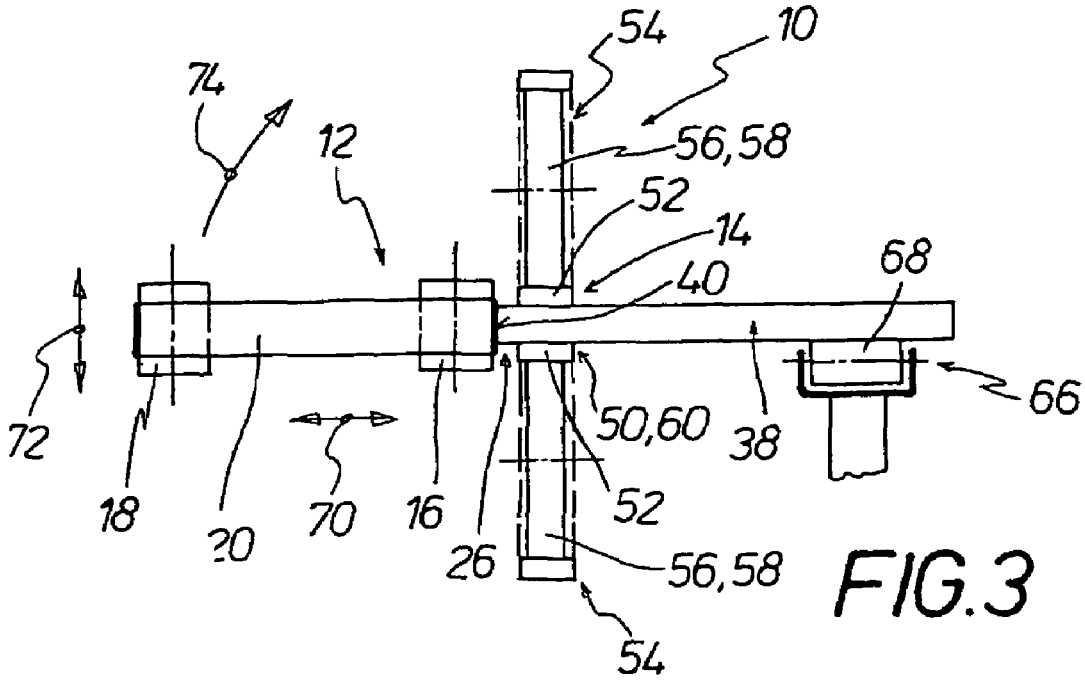
FIG. 3 shows a diagrammatic front view of the embossing apparatus in the direction of view of the arrow III in FIG. 1.

The transport device 14, for example, in addition to the two endless members 54, is provided with a supporting arrangement 66 having for example mounting rollers 68 on which the respective dimensionally stable substrate body 38 to be embossed upon is supported in a defined relationship, as is also diagrammatically indicated in FIG. 3.

In FIGS. 1, 2 and 3 the same features are each denoted by the same respective references so that there is no need for all features to be respectively described again in detail, in connection with those Figures.

FIG. 3 also diagrammatically shows that the embossing station 12 is displaceable in two mutually perpendicular directions in space in relation to the transport device 14 for the respective substrate body 38 which is stable in respect of shape, that is to be embossed. This is indicated by the arrow 70 and by the arrow 72. The arrow 70 illustrates displacement of the embossing station 12 in a horizontal direction towards the substrate body 38 which is stable in respect of shape, that is to be embossed upon, and away from same, and the arrow 72 indicates displaceability of the embossing station 12 in a vertical direction, that is to say in height in relation to the stable substrate body 38 which is to be embossed. The arcuate arrow 74 illustrates the pivotability of the embossing station 12 about a pivot axis oriented in parallel relationship with the advance direction of the transport device 14. The advance direction of the transport device 14 is indicated by the arrows 76 in FIGS. 1 and 2. The advance speed of the transport device 14 in the direction of the arrow 76 corresponds to the advance speed 34 of the embossing belt 20 and the speed 48 of the embossing film 44.

Figure 4:
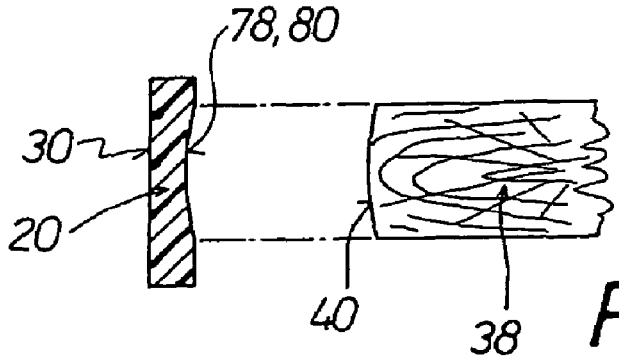
FIG. 4 shows a portion of a dimensionally stable substrate body which is to be embossed upon and at a spacing therefrom an associated, suitably profiled embossing belt in a cross-sectional view.

FIG. 4 shows a portion of a substrate body 38 which is dimensionally stable and which is to be embossed at its narrow side 40. The narrow side 40 is of a cambered, that is to say convex, profile. In a corresponding manner, at its embossing side 78 the embossing belt 20 has a profiling 80 which is adapted to the profile of the narrow side 40.

Figure 5:
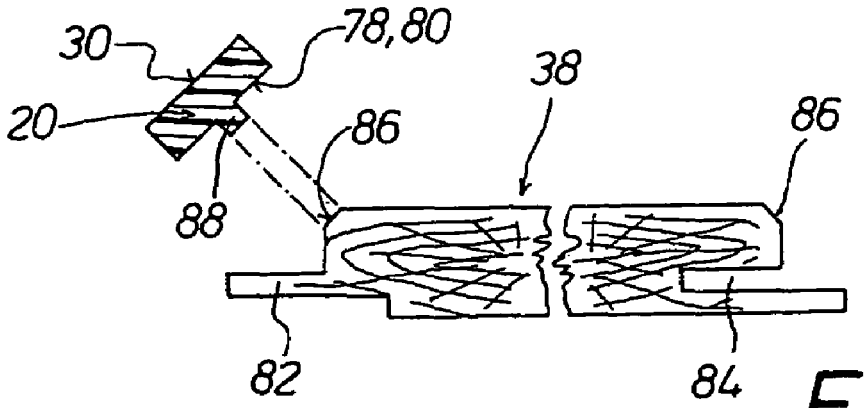
FIG. 5 shows a view similar to FIG. 4 of an embossing belt with different profiling for another dimensionally stable substrate body which is to be embossed upon.

FIG. 5 shows a portion of a substrate body 38 which is stable in respect of shape, in the form of a board or panel having a tongue 82 and a groove 84 matching same and having bevel surfaces 86 which are to be embossed with a suitable embossing film 44 (see FIG. 1). For that purpose, that is to say for embossing on the respective bevel surface 86, the embossing belt 20 is correspondingly profiled at its embossing side 78 with a rib-shaped ridge 88.

The embossing belt 20 can be suitably profiled at its embossing side 78 to suitably match the respective substrate body 38 which is stable in respect of shape, that is to be embossed. It will be appreciated that the invention is not limited to the configurations diagrammatically illustrated in FIGS. 4 and 5.

The invention claimed is:

1. A transport device in an embossing apparatus which is provided for transferring a transfer layer of an embossing film on to a substrate body which is stable in respect of shape, and which has an embossing station having two mutually spaced support rollers around which an embossing belt runs, wherein an embossing section of the embossing belt is defined by the two mutually spaced support rollers, wherein the transport device provided for transporting the substrate body which is stable in respect of shape and which is to be embossed is disposed parallel to the embossing section and in proximity of the embossing station, and the embossing belt and the transport device are driven simultaneously at a same advanced speed, wherein the transport device comprises a fixing device with fixing elements which form at least one endless member by which at least one fixing section parallel to the embossing section for the substrate body which is to be embossed is defined.

2. A transport device as set forth in claim 1, wherein the fixing device comprises a clamping device having clamping elements which form two mutually adjacent endless members by which there is defined a common clamping section in parallel relationship with the embossing section for the substrate body to be embossed.

3. A transport device as set forth in claim 2, wherein the clamping elements are connected pivotably with respect to the at least one endless member.

4. A transport device as set forth in claim 1, wherein the fixing device comprises suction elements which are connected together pivotably relative to a single one of the at least one endless member.

5. A transport device as set forth in claim 1, wherein the embossing station comprises a deflection roller which is provided in a triangle in a common plane with the two mutually spaced support rollers and around which the embossing belt is deflected.

6. A transport device as set forth in claim 1, wherein a heating device is associated with the embossing belt.

7. A transport device as set forth in claim 1, wherein the embossing belt is driven by means of a first drive device and the transport device is driven by means of a second drive device simultaneously in mutually matched relationship.

8. A transport device as set forth in claim 1, wherein at its embossing side, which is towards the transport device, the embossing belt comprises a profiling which is adapted to the substrate body to be embossed.

9. A transport device as set forth in claim 1, wherein the embossing station is displaceable in relation to the transport device.

10. A transport device as set forth in claim 9, wherein the embossing station is pivotable about a pivot axis oriented in parallel relationship with an advance direction of the transport device.

11. A transport device as set forth in claim 1, wherein, provided between the two mutually spaced support rollers along the embossing section, is at least one stabilization roller bearing against the embossing belt.

12. A transport device as set forth in claim 1, wherein the transport device serves for holding the substrate body in relation to the embossing apparatus in order to emboss a narrow side of the substrate body.

13. A transport device as set forth in claim 1, wherein the transport device serves for holding the substrate body in relation to the embossing apparatus in order to emboss a peripheral edge of the substrate body.

14. A transport device as set forth in claim 1, wherein the transport device is adapted to rotate the substrate body.

* * * * *